US005522204A

United States Patent [19]

Wood

[11] Patent Number: 5,522,204

[45] Date of Patent: Jun. 4, 1996

[54] DESICCANT CONTAINER

[75] Inventor: Raymond B. Wood, Brookville, Ohio

[73] Assignee: Stanhope Products Company, Brookville, Ohio

[21] Appl. No.: 235,283

[22] Filed: Apr. 29, 1994

[51] Int. Cl.[6] ..... B65B 7/28; B01D 27/02; F25B 43/00

[52] U.S. Cl. ..... 53/452; 53/485; 210/282; 210/DIG. 6

[58] Field of Search ..... 53/489, 485, 471, 53/452, 329; 55/510, DIG. 17; 210/282, DIG. 6; 62/474, 85

[56] References Cited

U.S. PATENT DOCUMENTS

| | | | |
|---|---|---|---|
| 1,776,558 | 9/1930 | Herman . | |
| 2,148,770 | 2/1939 | Mittendorf | 210/131 |
| 2,181,511 | 11/1939 | Domoto | 220/20 |
| 2,325,657 | 8/1943 | Burkness | 210/134 |
| 2,482,779 | 9/1949 | Katz . | |
| 2,661,870 | 12/1953 | Huenergardt . | |
| 3,545,227 | 12/1970 | Grahl | 62/474 |
| 3,799,352 | 3/1974 | McClive | 210/282 |
| 3,879,292 | 4/1975 | McClive | 210/282 |
| 3,918,578 | 11/1975 | Cullen et al. | 206/204 |
| 3,926,599 | 12/1975 | Rudin et al. | 55/387 |
| 4,266,408 | 5/1981 | Krause | 62/474 |
| 4,436,623 | 3/1984 | Cullen et al. | 210/282 |
| 4,457,843 | 7/1984 | Cullen et al. | 210/282 |
| 4,573,632 | 3/1986 | Scheeren . | |
| 4,623,368 | 11/1986 | Lancesseur | 55/387 |
| 4,764,274 | 8/1988 | Miller | 210/282 X |
| 4,800,018 | 1/1989 | Moser | 210/282 X |
| 4,882,052 | 11/1989 | Peranio | 210/282 |
| 4,921,512 | 5/1990 | Maryyanek et al. | 55/488 |
| 5,038,582 | 8/1991 | Takamatsu | 62/474 |
| 5,184,480 | 2/1993 | Kolpacke | 210/DIG. 6 X |
| 5,435,153 | 7/1995 | Hutchison et al. | 62/474 |

*Primary Examiner*—James F. Coan
*Attorney, Agent, or Firm*—Biebel & French

[57] ABSTRACT

A container for particulate desiccant comprises a cup and a cap. The cup includes spaced inner and outer wall portions connected by a transverse web portion to define a chamber having an opening. The cap is designed for receipt in the chamber to cover the opening. In addition, the cap has a hole for receiving the inner wall portion of the cup. According to one embodiment, the inner wall portion includes an integral detent formed therein and positioned to detain the cap in place. The cap has a peripheral surface adapted to rest on a shoulder formed along the inner surface of the outer wall portion of the cup to detain the cap in place. The outer wall of the cup has a resilient flange member that protrudes outwardly from the cup. This flange is adapted to provide snug, friction fit of the cup within a fluid flow housing such as an air conditioner accumulator or the like.

19 Claims, 4 Drawing Sheets

DESICCANT CONTAINER

BACKGROUND OF THE INVENTION

1. Field of the Invention

This invention relates to air or fluid dryers, and more particularly, it relates to desiccant containers for use as proximity dryers or as flow-through filter-dryers for liquid refrigerant in-line installations in automotive air conditioning systems and the like.

2. Background of the Invention

Desiccants are commonly used in automotive air conditioning systems for dehydrating air and refrigerants. Particulate desiccants are common in such systems because the high surface area-to-volume ratios of the particles facilitates the interaction of the particles with surrounding air or fluid. Since the particles of desiccant must be held in the air or fluid stream and prevented from contaminating other parts of the system, the particles must be held in a container which is permeable to the air or fluid but impermeable to the particles.

One form of dryer used in automotive air conditioning systems includes an elongated receiver or accumulator canister having inlet and outlet ports communicating with the interior of the canister. A desiccant container is positioned in the interior of the canister and allows for air and/or fluid through the desiccant material.

One form of package-type desiccant container for use in an accumulator or receiver dryer is constructed from synthetic felted wool or polyester which is filled with desiccant and then sealed by stitching or fusing. One drawback to this form of package is that the felted bag may not conform to the shape of the canister, so that air or fluid may bypass the desiccant. Another drawback is that the bag may be non-uniform in shape, thereby making automatic assembly of the dryer difficult.

If felted polyester is used as a less expensive substitute for felted wool, the seams of the bag may be formed by ultrasonic welding. Unfortunately, the reliability of such ultrasonic welds is questionable and the bag may open up, allowing adsorbent material to escape from the bag and potentially contaminate the system. In addition, the felted polyester bag is vulnerable to burn-through when the dryer is welded shut.

In another proposed form of an accumulator or receiver dryer, particulate desiccant is trapped between a pair of grids or plates which are welded or press fit inside the canister. According to one embodiment, the desiccant is charged by pouring the desiccant particles into the canister once a first of the grids or plates is positioned. A pipe extends through holes in the grids or plates to exhaust dried air to an outlet port. A dryer of this form is likely to be difficult to assemble because the grids or plates must be slid into position and, in some cases, welded inside the canister.

Furthermore, in those embodiments in which the desiccant particles are manually poured into the canister, the desiccant must be pre-measured due to the difficulty of controlling the amount of desiccant poured into the canister based on visual observation alone. The pouring of the desiccant creates a risk of accidental contamination outside the accumulator since desiccant particles may fall into the pipe communicating with the outlet port.

SUMMARY OF THE INVENTION

These drawbacks and others are overcome by means of the present invention embodied in a container for a particulate desiccant which comprises a generally cylindrical cup and a cap. The cup includes spaced inner and outer wall portions connected by a transverse web portion to define a chamber having an opening. The cap is designed for receipt in the chamber to hold the desired particulate desiccant material in place in the cup. In addition, the cap has a hole for receiving the inner wall portion of the cup when the cap is received in the chamber.

According to one embodiment, the inner wall portion includes an integral detent extending into the chamber and positioned to detain the cap in place. Two examples of such integral detents are a raised bead and a resilient flange. According to another embodiment, the outer wall of the container has an outwardly extending lip defining a peripheral surface for frictional engagement with an inner surface of the canister or housing of the air conditioning unit.

Both the transverse web portion and the cap are perforated to allow air or fluid to reach the desiccant housed thereon. The container includes first and second plies of permeable lining material which trap the particulate desiccant in the .container. In addition, the inner wall portion defines a sleeve open at either end on different sides of said container. This sleeve fits over a pipe communicating with one of the ports in the air conditioning system so that air or fluid passing through the desiccant may exit the system.

According to another aspect, the present invention is embodied in a desiccant container produced by casting a one-piece cup member including spaced inner and outer wall portions connected by a transverse web portion; inserting permeable lining material and desiccant beads or the like between the inner and outer wall portions such that the desiccant beads are trapped between plies of the permeable lining material; and sliding a central hole of a cap over the inner wall portion and into engagement with a detent to detain the cap and the particulate desiccant in the chamber.

In accordance with the invention, the desiccant material is placed into the container prior to insertion of the container into the canister. Accordingly, the amount of desiccant charged into the container is relatively easy to control and the risk that desiccant will enter a pipe communicating with one of the ports of the air conditioning system is minimized. Rigidity and uniformity of the container enable it to be automatically installed, if desired., into the dryer canister, while the container protects the permeable lining material from burn-through when the air conditioning or refrigeration system canister is welded.

The desiccant container may be fabricated from reusable or recyclable materials. Removable detention of the cap in the cartridge permits the desiccant container to be recharged with fresh desiccant without damaging the container.

Additionally, since the cup-shaped container is formed into a specific, definite shape and dimension depending on the particular canister in which it is to be housed, the air or refrigerant system is efficient, minimizing by-pass of the fluid flow from the desiccant particles which can in some cases occur.

Therefore, it is one object of the invention to provide a desiccant package which is simple to assemble, shaped to fit the dryer canister and capable of automatic installation. This and other objects, features and advantages of the present invention will be described in further detail in connection with preferred embodiments of the invention shown in the accompanying drawings, wherein:

DETAILED DESCRIPTION OF THE PREFERRED EMBODIMENTS

Figure 1:
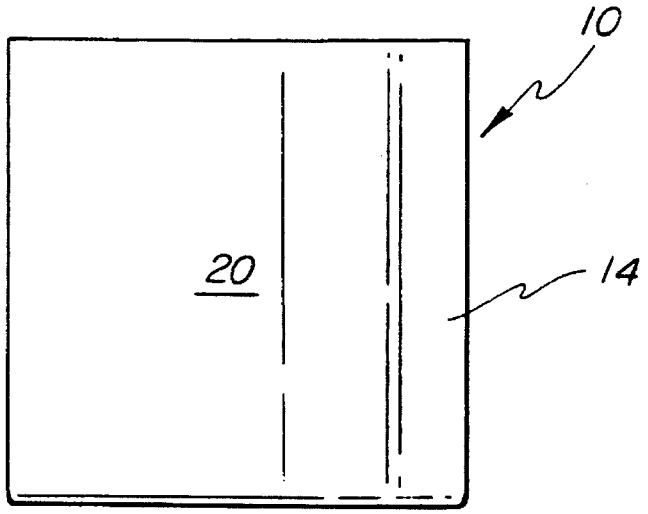
FIG. 1 is a front elevational view of a first embodiment of a desiccant container.
Figure 2:
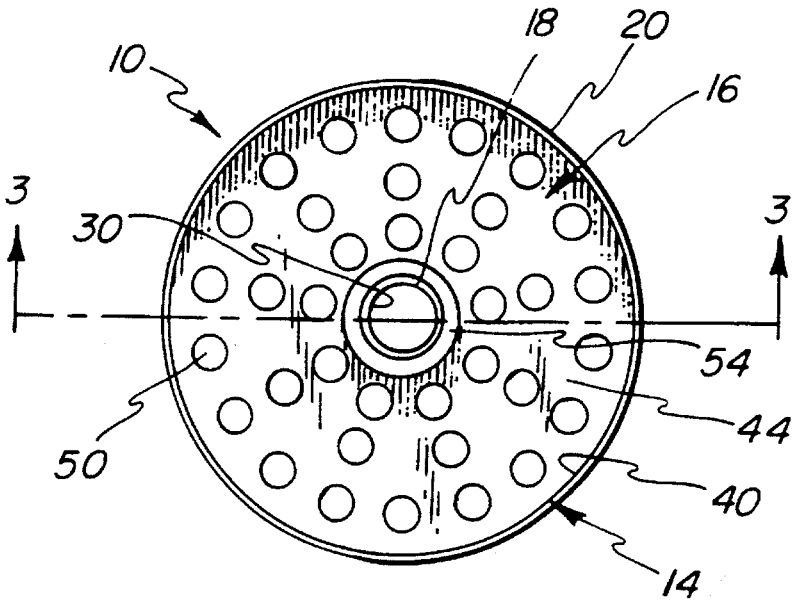
FIG. 2 is a top plan view of the desiccant container of FIG. 1.

As best shown in FIGS. 1–4, a first embodiment of a desiccant container 10 for holding particulate desiccant 12 comprises a generally cylindrically cross-sectioned cup 14 and a cap 16. The cup 14 is a one-piece plastic molding which includes a cylindrical inner wall portion 18, a cylindrical outer wall portion 20 concentric with the inner wall portion 18 and a bottom defined by transverse web portion 22. The inner and outer wall portions 18, 20 and the transverse web portion 22 define a chamber 24 having an opening 26.

The outer wall 20 is sized to fit snugly into the inside diameter of dryer canister to prevent air or fluid from bypassing the container 10. The cylindrical inner wall portion 18 defines a passage 30 which opens on a web side 32 and a cap side 34 of the container 10 so that the inner wall portion 18 may serve as a sleeve for receiving a pipe or conduit communicating with an outlet or inlet port of the dryer or refrigerant system.

Figure 3:
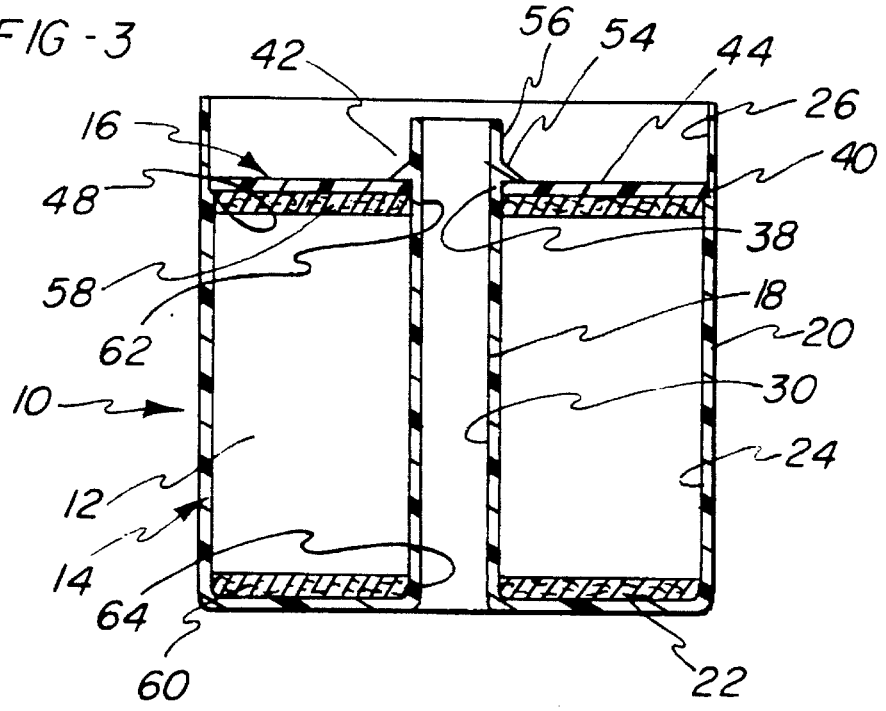
FIG. 3 is a cross-sectional view of the desiccant container taken along the line 3—3 in FIG. 2.
Figure 4:
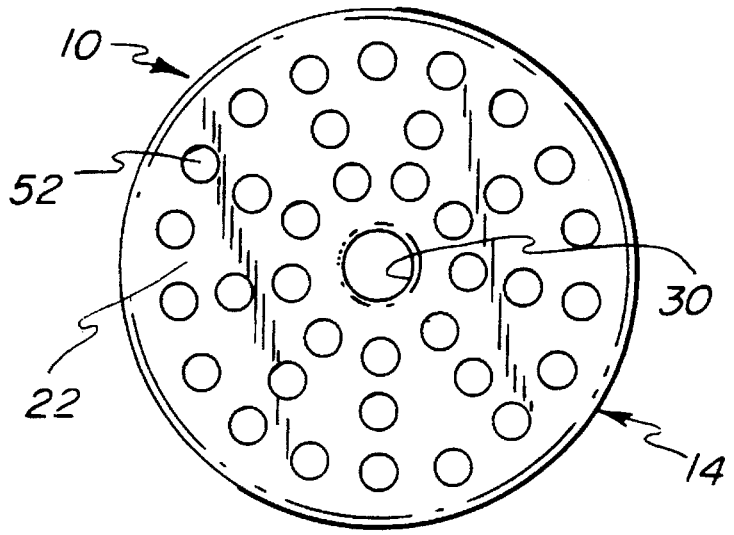
FIG. 4 is a bottom plan view of the desiccant container of FIG. 1.

As best shown in FIG. 3, the cap 16 is generally disc-shaped and has a central hole 38 for receiving the inner wall portion 18 of the cup 14. The cap 16 also includes a peripheral portion 40 and an inner mounting surface 42; each extending downwardly from the top of flat annular portion 44. The peripheral portion 40 is dimensioned for snug reception within inner shoulder 48 of the outer wall portion 20 to retain the cap 16 in the chamber 24 of the cup 14. Inner mounting surface 42 surrounds the hole 38. As shown, shoulder 48 extends along the circumference of the inside surface of outer wall 20.

Flat annular portion 44 of the cap 16 and the transverse web portion 22 of the cup 14 are each perforated with a number of symmetrically arrayed ports or perforations (one each shown at 50 and 52 FIG. 2 and 4) so that the flat annular portion 44 and the transverse web portion 22 are each permeable to the air or fluid to be dried. In the example shown, the ports 50, 52 are arranged in concentric annular rows such that the two inner rows have nine ports each and the outer row has eighteen ports. The precise arrangement of the ports is not critical to the operation of the desiccant container 10 as long as the desiccant 12 remains contained and air or fluid (not shown) is allowed to enter the container 10, interact evenly with the desiccant 12 and exhaust from the container 10.

The inner wall portion 18 includes an integral detent 54 formed on an outer surface 56 of the inner wall portion 18 in the form of a resilient flange tapered radially outwardly toward the interior of the chamber 24. The detent 54 presses against either the flat annular portion 44 of the cap 16 to detain the cap in the chamber 24. Since the detent 54 is resilient, the cap 16 may be detached from the detent 54 and removed from the chamber 24 to reach the desiccant 12.

Plies 58, 60 of a permeable lining material such as felted polyester or gauze are placed inside the chamber 24 near the transverse web portion 22 and the cap 16 to trap the desiccant in the container 10. The lining material must be permeable to the air or fluid (not shown) to be dried but impermeable to the particulate desiccant 12. If gauze is used, the mesh size of the gauze must be significantly smaller than the grain size of the desiccant. While the plies 58, 60 are shown in FIG. 3 as circular liners or pads having central holes 62, 64 embracing and surrounding the inner wall portion 18, the plies may also be separate plies of a permeable capsule or pouch (not shown), such as a torroidal capsule shaped to surround the inner wall portion 18.

A second embodiment of a desiccant container 10 is shown in FIGS. 5–8. In particular, the desiccant container 10 for holding particulate desiccant 12 comprises a generally cylindrically cross-sectioned cup 14 and a cap 16. The cup 14 is a one-piece plastic molding which includes a cylindrical inner wall portion 18, a cylindrical outer wall portion 20 concentric with the inner wall portion 18 and a bottom defined by transverse web portion 22. The inner and outer wall portions 18, 20 and the transverse web portion 22 define a chamber 24 having an opening 26. The transverse web portion 22 is perforated (not shown) to conduct air or fluid (not shown) into or out of the chamber 24.

Figure 7:
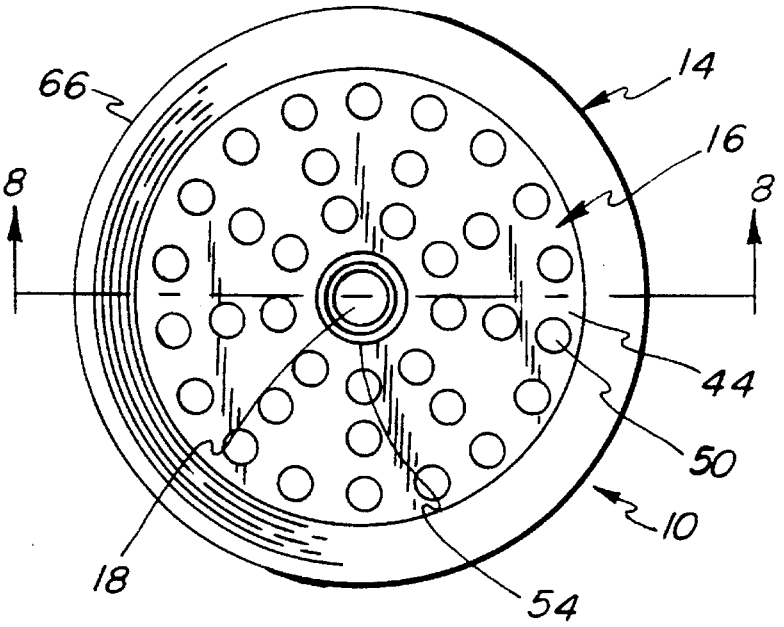
FIG. 7 is a top plan view of the desiccant container shown in FIG. 5.
Figure 8:
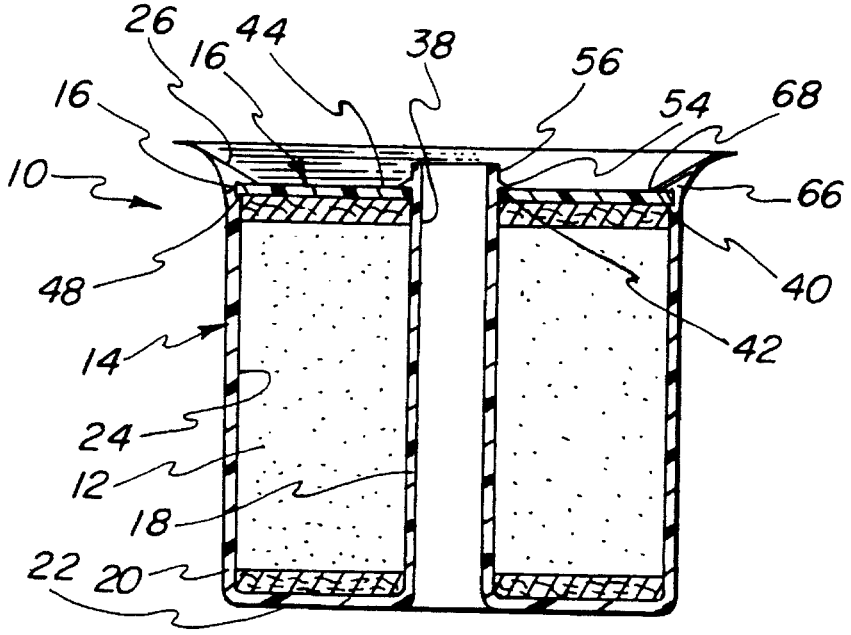
FIG. 8 is a cross-sectional view of the canister shown in FIG. 7, taken along the line 8—8 of FIG. 7.

As best shown FIGS. 7 and 8, the cap 16 is generally disc-shaped and has a central hole 38 for receiving the inner wall portion 18 of the cartridge 14. The cap 16 optionally also includes a peripheral portion 40 which extends along the perimeter of the cap 16 and an inner mounting surface 42 which surrounds the hole 38. The flat annular portion 44 is perforated as at 50 to conduct air or fluid (not shown) into or out of the chamber 24.

The inner wall portion 18 includes an integral detent 54 formed on outer surface 56 of the inner wall portion 18. Here, the detent 54 is shaped as a bead rather than a resilient flange, however. The detent 54 in the form of a bead may extend continuously around a cross-section of the outer surface 56 as shown in FIGS. 7 and 8 or may consist of one or more beads discontinuously distributed on a cross-section of the outer surface 56. Preferably, the inner wall portion 18 and the detent 54 have sufficient resilience that the cap 16 may be detached from the inner wall portion 18 and removed from the chamber 24 to reach the desiccant 12.

The outer wall portion 20 includes an outwardly flared lip 66. The flared lip 66 terminates in a shoulder 68 which engages peripheral portion 40 of the cap. Flared lip 66 is adapted to resiliently fit within the lid of canister 28. This lip facilitates snug fit of the cup within the canister of the appropriate air conditioning or refrigeration system. The lip further serves as a seal to prevent air or fluid escape that may otherwise occur along the interface between the circumference of the cup and the lid of the canister.

Figure 6:
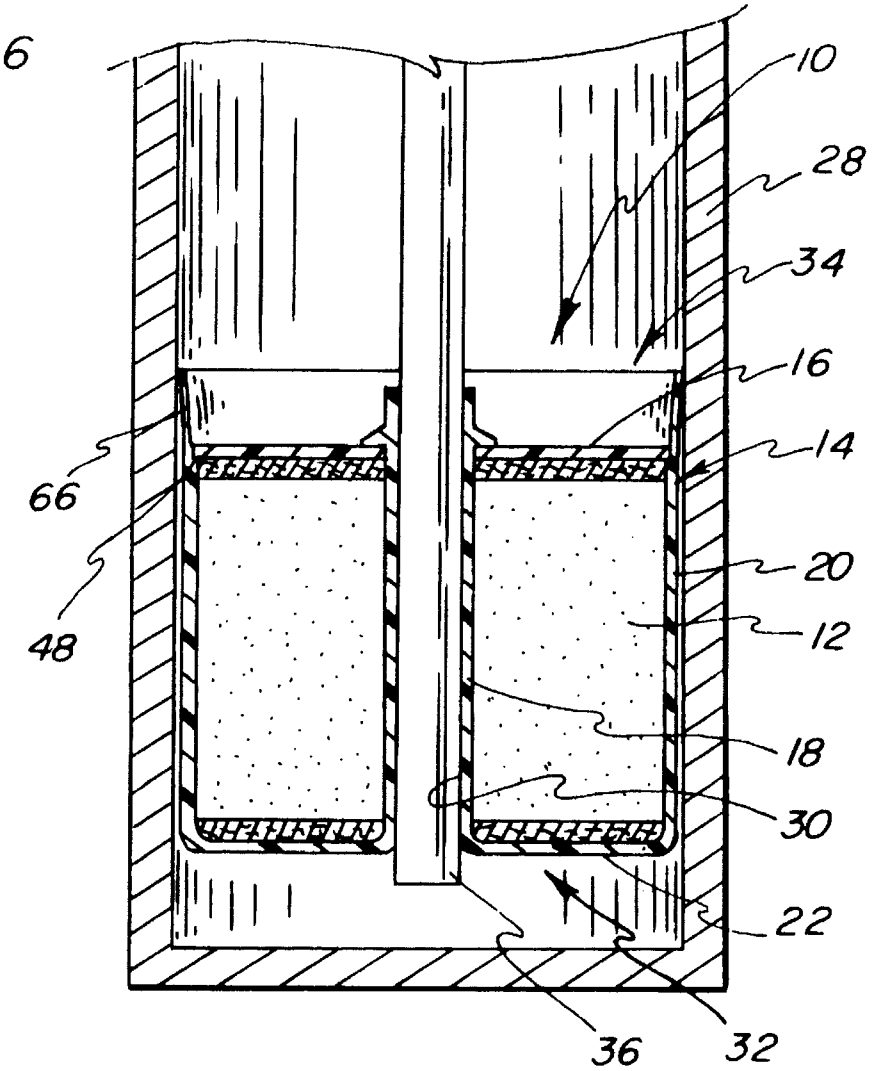
FIG. 6 is a cross-sectional view of the desiccant container of FIG. 5 installed in a canister of an accumulator or receiver dryer.
Figure 5:
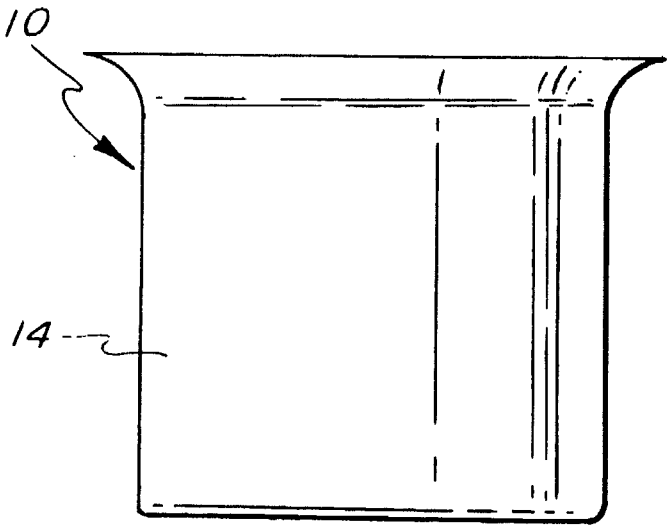
FIG. 5 is a front elevational view of a second embodiment of the invention.

Turning now to FIG. 6, it can be seen that lip 66 resiliently bears upon inside diameter of dryer canister 28 to provide a snug fit of the container 10 in the canister 28. The lip 66 also serves to prevent air or fluid from bypassing the container so as to ensure passage thereof over the desiccant particles or beads. Cylindrical inner wall portion 18 defines passage 30 which serves as a sleeve for receiving conduit 36 communicating with an inlet portion or outlet portion of the dryer or refrigerant system.

One method for fabricating the desiccant container 10 includes the step of casting or injection molding the cup 14 to form a one-piece plastic member having the inner and outer wall portions 18, 20 connected by the transverse web portion 22. One plastic suited for use in casting the cup 14 is polypropylene. Polyethylene may also be used but is not preferred. The cap 16 is likewise cast from plastic. The permeable lining material 58, 60 and the desiccant 12 are inserted into the chamber 24 between the inner and outer wall portions 18, 20 such that the desiccant particles 12 are trapped between the plies 58, 60 of the permeable lining material. Then, the hole 38 in the cap 16 is slid over the inner wall portion 18 and into engagement with the detent 54 to detain the cap 16 and the particulate desiccant 12 in the chamber 24.

Preferably, permeable lining material and desiccant are inserted by sliding a first ply 58 of the plies 58, 60 down the inner wall portion 18 and placed adjacent to the transverse web portion 22. The desiccant is then charged into the chamber 24, as by pouring. Since the chamber 24 is torroidal and relatively shallow, the height of the desiccant 12 in the chamber 24 can be seen through the opening 26 so that the proper amount of desiccant is charged in a manual operation. Once the desiccant is charged, a second ply 60 of the plies 58, 60 is slid down the inner wall portion 18 against the desiccant 12.

The cup 14 may be vibrator or bowl fed to a robotic arm for automatic installation into a dryer canister 28 (partially shown in section in FIG. 6). Furthermore, the plies 58, 60 of lining material are relatively resistant to burn-through in the cup 14 while the dryer canister 28 is being welded (not shown). As stated previously, the cup 14 may be sized to fit snugly in the canister 28 to inhibit bypass flow of air or fluid (not shown) to be dried. The detents and friction fits used to detain the cap 16 on the cup 14 are highly reliable so that the risk that desiccant will escape and contaminate other parts of the air conditioning or refrigeration system (not shown)is minimized.

Various changes or modifications in the invention described may occur to those skilled in the art without departing from the true spirit or scope of the invention. The above description of preferred. embodiments of the invention is intended to be illustrative and not limiting, and it is not intended that the invention be restricted thereto but that it be limited only by the true spirit and scope of the appended claims.

What is claimed is:

1. A method for making a desiccant container comprising the steps of:

casting a one-piece cup member including spaced inner and outer wall portions connected by a transverse web portion, providing a detent member on said inner wall;

inserting desiccant particles between the inner and outer wall portions;

providing a cap member having a hole therein; and sliding said hole in said cap over the inner wall portion and into engagement with said detent to detain the cap in said cup.

2. A desiccant container produced by the process recited in claim 1.

3. A container for a particulate desiccant, said container comprising:

a cup member including spaced inner and outer wall portions connected by a transverse web portion to define a chamber having an opening; and a cap for receipt in said chamber, said cap having a hole for receiving said inner wall portion when said cap is received in said chamber;

said inner wall portion including a detent protruding from said inner wall to detain said cap in said chamber.

4. The container as recited in claim 1 wherein said outer wall portion includes a flared lip extending outwardly from said outer wall.

5. The container as recited in claim 1 wherein said inner wall portion defines a sleeve open at either end on different sides of said container.

6. The container as recited in claim 1 wherein said detent is a raised bead on said inner wall portion.

7. The container as recited in claim 1 wherein said transverse web portion and said cap include perforations therein.

8. The container as recited in claim 1 wherein said inner and outer walls are concentric cylinders.

9. A container as recited in claim 1 wherein said cap has a peripheral surface adapted for frictional engagement with an inner surface of said outer wall portion to detain said cap in said chamber.

10. A container as recited in claim 1 wherein said cup is a one-piece casting.

11. A desiccant container adapted for receipt inside an inner peripheral wall of a fluid flow housing, said container comprising:

a cup including spaced inner and outer walls connected by a transverse web portion to define a chamber having an opening; and a cap for receipt in said chamber, said cap having a hole for receiving said inner wall portion when said cap is received in said chamber;

said outer wall having a peripheral lip extending outwardly therefrom adapted for frictional engagement with said inner peripheral wall of said housing.

12. The container as recited in claim 11 wherein said transverse web portion and said cap include perforations therein.

13. The container as recited in claim 11 wherein said inner and outer walls are concentric cylinders.

14. The container as recited in claim 11 wherein said inner wall portion defines a passage open at either end on different sides of said container.

15. The container as recited in claim 11 including first and second plies of permeable lining material for placement in said chamber to trap the particulate desiccant in said container.

16. A container as recited in claim 11 wherein said cartridge is a one-piece casting.

17. A container for a particulate desiccant, said container comprising:

a cup member including spaced inner and outer wall portions connected by a transverse web portion to define a chamber having an opening; and a cap for receipt in said chamber, said cap having a hole for receiving said inner wall portion when said cap is received in said chamber;

said inner wall portion including a detent positioned to detain said cap in said chamber, said detent comprising a raised bead on said inner wall portion.

18. A container for a particulate desiccant, said container comprising:

a cup member including spaced inner and outer wall portions connected by a transverse web portion to define a chamber having an opening; and a cap for receipt in said chamber, said cap having a hole for receiving said inner wall portion when said cap is received in said chamber;

said inner wall portion including a detent positioned to detain said cap in said chamber, said detent comprising a resilient flange on said inner wall portion.

19. A method for making a desiccant container for use within a fluid flow housing, said method comprising the steps of:

casting a one-piece cup member including spaced inner and outer wall portions connected by a transverse web portion, providing an outwardly extending lip member from said outer wall;

inserting desiccant particles between the inner and outer wall portions;

providing a cap member having a hole therein; and sliding said cap over said inner wall and detaining said cap in said cup.

* * * * *